US011491068B2

(12) United States Patent
Carlson et al.

(10) Patent No.: US 11,491,068 B2
(45) Date of Patent: Nov. 8, 2022

(54) CREMATED REMAINS REMEMBRANCE SYSTEM

(71) Applicants: Charles Carlson, Woodbury, MN (US); Rodrick Charles Peddycoart, Hudson, WI (US)

(72) Inventors: Charles Carlson, Woodbury, MN (US); Rodrick Charles Peddycoart, Hudson, WI (US)

( * ) Notice: Subject to any disclaimer, the term of this patent is extended or adjusted under 35 U.S.C. 154(b) by 0 days.

(21) Appl. No.: 17/321,015

(22) Filed: May 14, 2021

(65) Prior Publication Data

US 2021/0353488 A1 Nov. 18, 2021

Related U.S. Application Data

(60) Provisional application No. 63/025,194, filed on May 15, 2020.

(51) Int. Cl.
*A61G 17/08* (2006.01)

(52) U.S. Cl.
CPC ..... *A61G 17/08* (2013.01)

(58) Field of Classification Search
CPC ..... A61G 17/08; E04H 13/008
USPC ..... 27/1, 35
See application file for complete search history.

(56) References Cited

U.S. PATENT DOCUMENTS 4,328,606 A * 5/1982 Nunes ..... A61G 17/007 27/35
5,379,499 A * 1/1995 Jackson ..... A61G 17/08 27/35
5,815,897 A 10/1998 Longstreth
6,023,822 A * 2/2000 Luebke ..... A61G 17/08 27/1
6,279,212 B1 8/2001 Balch
6,944,921 B1 * 9/2005 Gersten ..... E04H 13/008 27/1
8,448,388 B1 5/2013 Karenbauer
8,943,762 B2 * 2/2015 Carlson ..... A61G 17/0136 27/DIG. 1
10,610,437 B2 4/2020 Reynolds
2001/0049867 A1 * 12/2001 Tseng ..... A61G 17/08 27/1

(Continued)

FOREIGN PATENT DOCUMENTS

CN 203017319 U 6/2013
JP 2002360642 A * 12/2002

OTHER PUBLICATIONS

International Search Report and Written Opinion received for PCT Serial No. PCT/US2021/032544.

*Primary Examiner* — William L Miller
(74) *Attorney, Agent, or Firm* — Michael A. Bondi; Moss & Barnett

(57) ABSTRACT

A cremated remains remembrance system including a vase, an urn, a vase lid and a decorative ring. The vase has an opening formed therein. The vase has a first attachment mechanism. The urn in which cremated remains are placed. The urn may be placed at least partially in the vase opening. The vase lid is capable of engaging the first attachment mechanism to substantially close the vase opening. The decorative ring has an opening extending therethrough. The decorative ring is capable of engaging the first attachment mechanism to substantially cover the first attachment mechanism when the urn is not in the vase opening and the vase lid is not attached to the vase.

16 Claims, 9 Drawing Sheets

(56) References Cited

U.S. PATENT DOCUMENTS

| | | | | |
|---|---|---|---|---|
| 2006/0179624 | A1* | 8/2006 | Glass | A61G 17/007 27/1 |
| 2021/0275377 | A1* | 9/2021 | Agar | A61G 17/007 |
| 2021/0378901 | A1* | 12/2021 | Bell | A61G 17/08 |

* cited by examiner

CREMATED REMAINS REMEMBRANCE SYSTEM

REFERENCE TO RELATED APPLICATION

This application claims priority to Provisional Applic. No. 63/025,194, filed on May 15, 2020, the contents of which are incorporated herein by reference.

FIELD OF THE INVENTION

The invention relates generally funeral products for interment of cremated remains. More particularly, the invention relates to a cremated remains remembrance system.

BACKGROUND OF THE INVENTION

Many different frame constructions, depositories, memorial holders and columbarium storage systems have been devised for the interment of human cremated remains for memorialization purposes. Memorial urns have been designed for storing the cremated remains in a repository structure, such as a columbarium or within an individual's residence. Alternatively, cremated remains are placed in a garden at a crematoria, cemetery, or spread at sea or on land at a particular location. In such an instance, a burial urn is not necessary. Placing cremated remains in a garden at a crematorium or cemetery does not allow the cremated remains to be contained in any type of receptacle. This method does not provide a way to preserve the integrity of the cremated remains.

However, there has always been a demand for unique or different ways of memorializing a deceased person. None of these moralizing structures have involved the ability to arrange cinerary urns of individuals, couples or family members in a multi-urn burial container. A burial container is a container that houses the cinerary urns. The burial container maybe eliminated if a burial vault structure is required, which intern will house the cinerary urns.

In the funeral industry cremation has become an accepted option for the interment of human remains. Currently, it is the custom that human remains may be stored in an urn, placed in a columbarium, scattered at a designated location or buried under customary policies or applicable statutes.

In recent years many religions, including various Christian faiths have changed their position on cremation from historically discouragement to acceptance due to the growing reality of cost and space considerations for traditional cemetery burials.

While the church has modified its position and has allowed Christians to select cremation as an option, many still choose the burial of cremated remains as a means of complying with traditional Christian preferences.

Currently, some of the challenges incurred with the burial of cremated human remains are: First, it is very expensive since a burial plot must be purchased. Secondly, one does not generally have total control of the deceased's remains or the preferred burial site location or arrangement. Thirdly, one cannot with certainty, provide interment with a spouse, partner, children, parent or other loved one (cherished person). Finally, one cannot generally relocate the deceased's remains, at a future date, if so desired.

SUMMARY OF THE INVENTION

An embodiment of the invention is directed to a cremated remains remembrance system that includes a vase, an urn, a vase lid and a decorative ring. The vase has an opening formed therein. The vase has a first attachment mechanism. The urn is adapted to cremated remains. The urn may be placed at least partially in the vase opening. The vase lid is capable of engaging the first attachment mechanism to substantially close the vase opening. The decorative ring has an opening extending therethrough. The decorative ring is capable of engaging the first attachment mechanism to substantially cover the first attachment mechanism when the urn is not in the vase opening and the vase lid is not attached to the vase.

Another embodiment of the invention is directed to a cremated remains remembrance method. A vase is provided having an opening formed therein. The vase has a first attachment mechanism. Cremated remains are placed in an urn. The urn is positioned at least partially in the vase opening. A vase lid is attached to the vase by engaging the first attachment mechanism to substantially close the vase opening. The vase lid is detached from the vase. The urn is removed from the vase opening. A decorative ring is attached to the vase by engaging the first attachment mechanism. The decorative ring has an opening extending therethrough. When the decorative ring is attached to the vase, the decorative ring substantially covers the first attachment mechanism.

Another embodiment of the invention is directed to a method of forming a household decoration. A vase is provided having an opening formed therein. The vase has a first attachment mechanism. Cremated remains are placed in an urn. The urn is positioned at least partially in the vase opening. A vase lid is attached to the vase by engaging the first attachment mechanism to substantially close the vase opening. The vase lid is detached from the vase. The urn is removed from the vase opening. A decorative ring is attached to the vase by engaging the first attachment mechanism. The decorative ring has an opening extending therethrough. When the decorative ring is attached to the vase, the decorative ring substantially covers the first attachment mechanism to form a household decoration.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
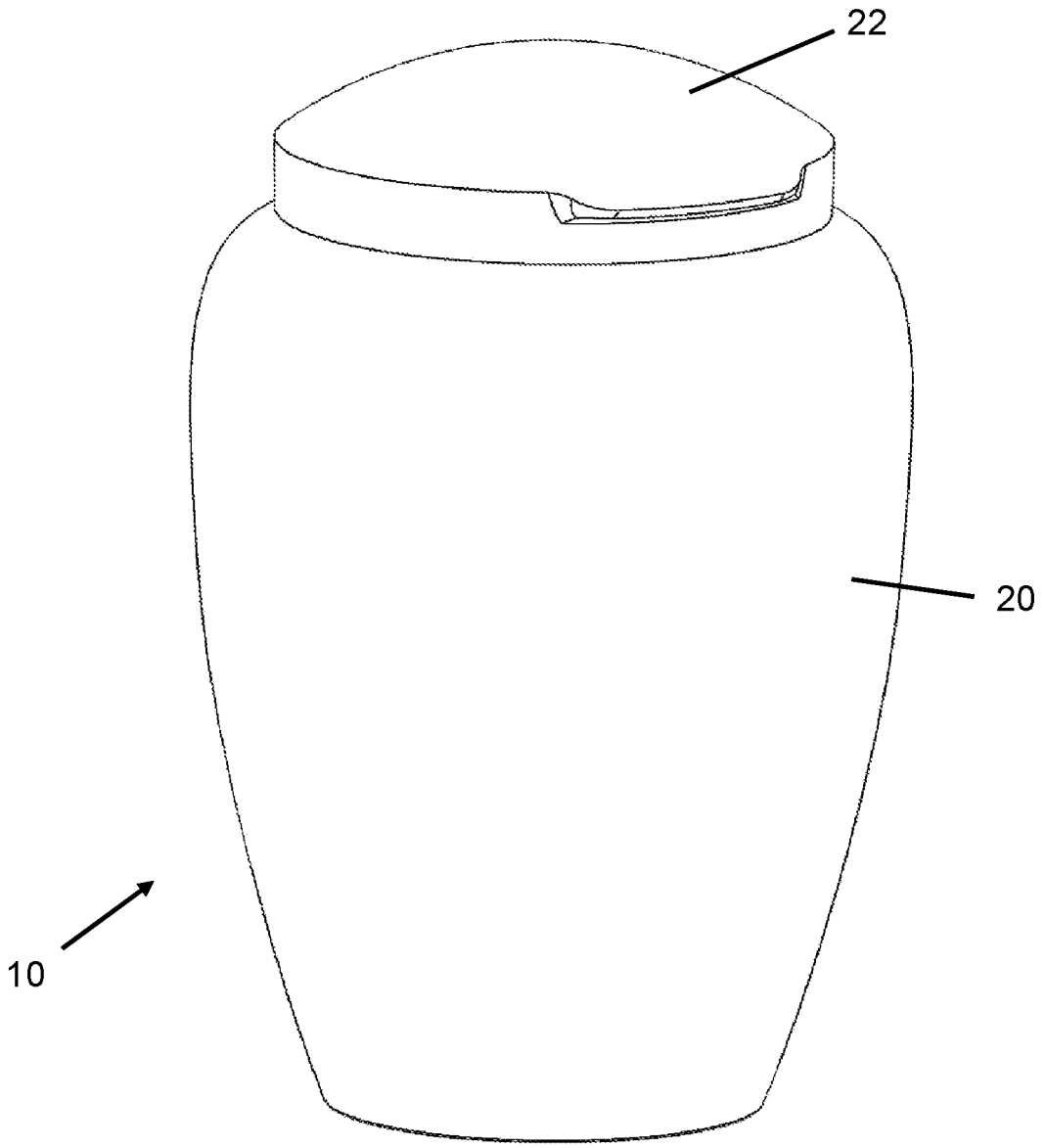
FIG. 1 is a perspective view of a cremated remains remembrance system according to an embodiment of the invention.
Figure 2:
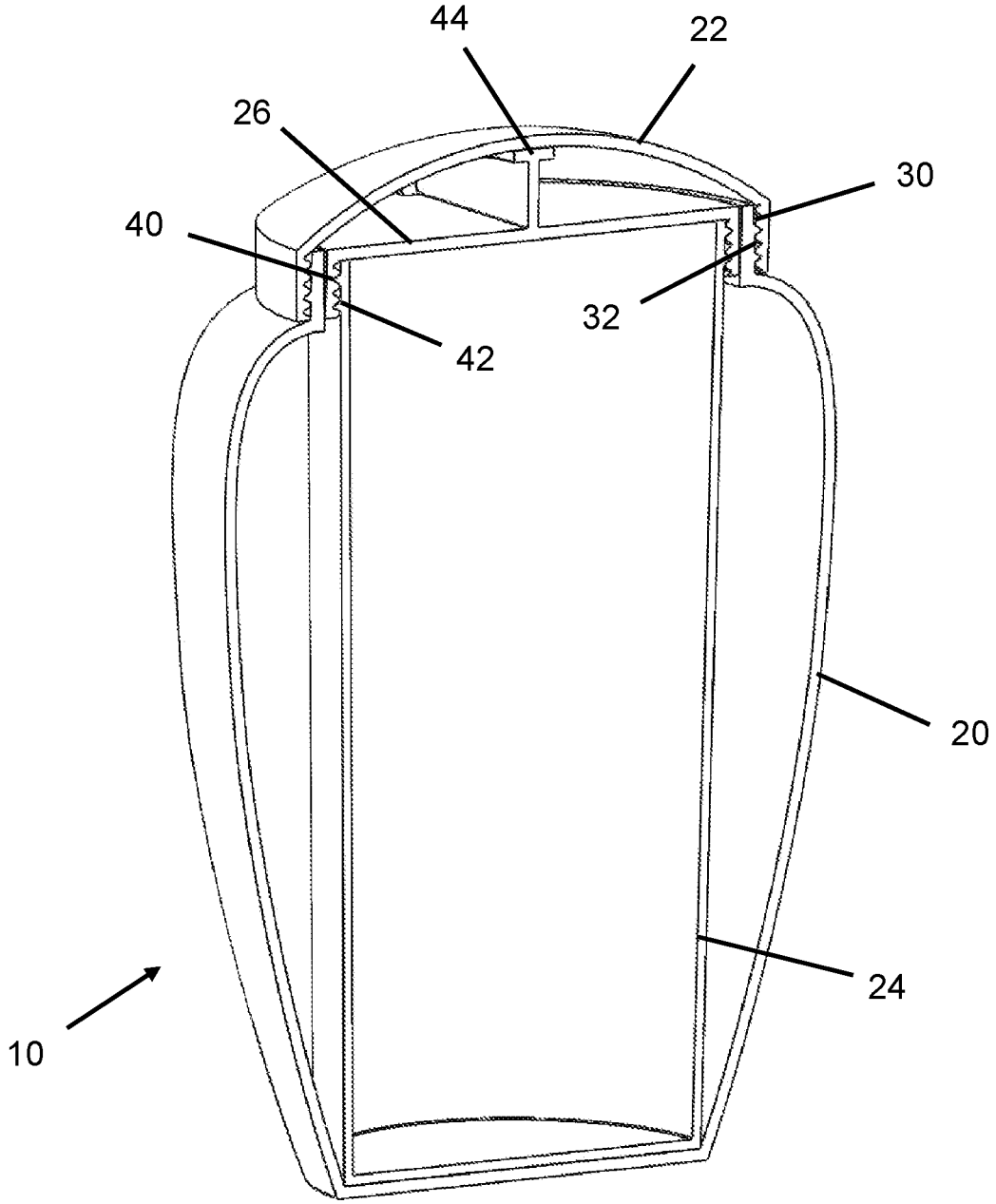
FIG. 2 is a sectional view of the cremated remains remembrance system.
Figure 3:
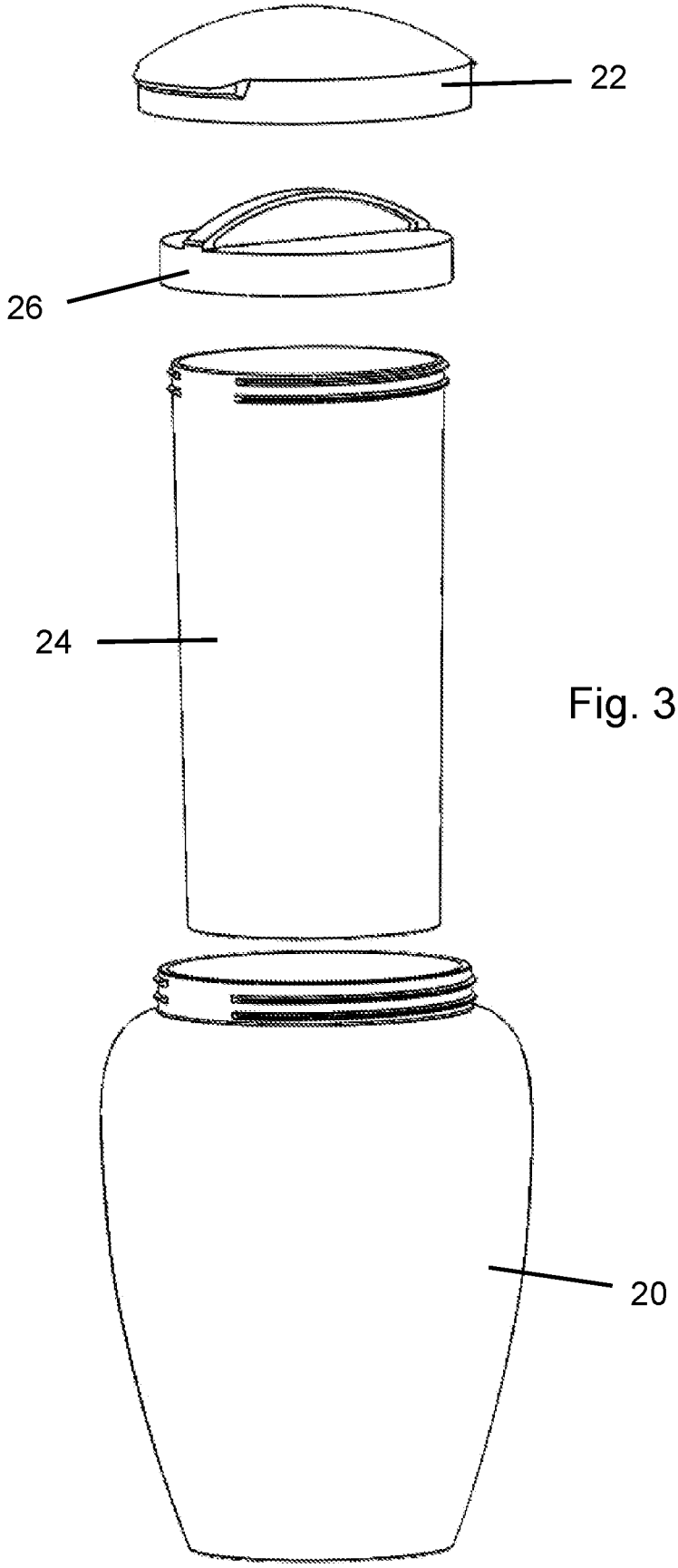
FIG. 3 is an exploded perspective view of the cremated remains remembrance system.

An embodiment of the invention is directed to a cremated remains remembrance system as illustrated at 10 in FIGS. 1-3. The cremated remains remembrance system 10 generally includes a vase 20, a vase lid 22, an urn body 24, an urn lid 26 and a decorative ring 50.

The vase 20 may assume a variety of shapes using the concepts of the invention. The vase 20 has an opening 28 formed therein that is adapted to receive at least a portion of the urn body 24. Proximate the vase opening 28, a vase thread 30 is provided. The vase thread 30 facilitates removable attachment of the vase lid 22 to the vase 20. A person of skill in the art will appreciate that the number of threads in the vase thread 30 as well as the shape and size of the threads in the vase thread 30 may be varied such as to increase the sealing ability.

Figure 4:
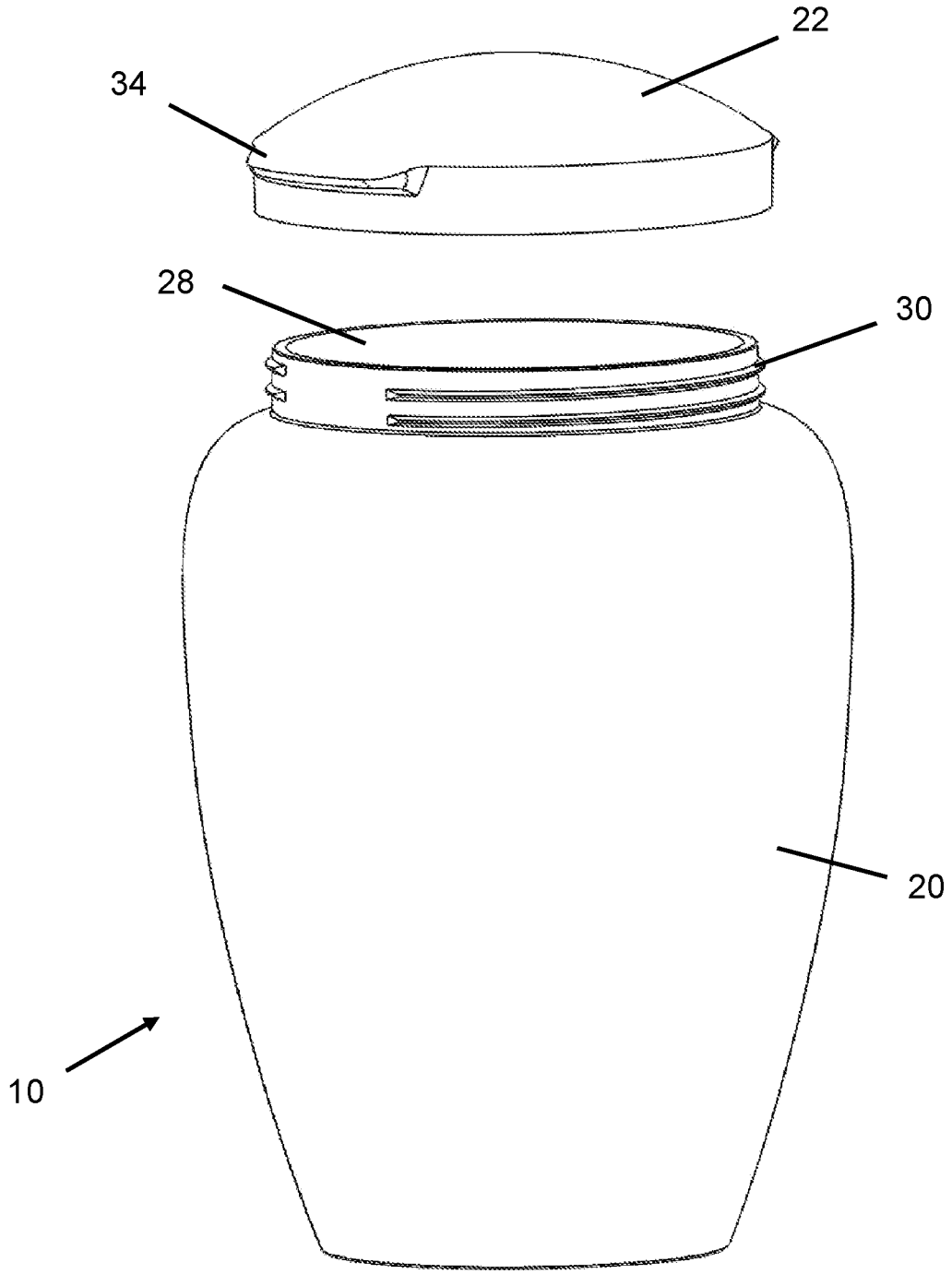
FIG. 4 is an exploded perspective view of a vase and a vase lid for the cremated remains remembrance system.

While it is illustrated in FIG. 4 that the vase thread 30 is on an outer surface of the vase 20, it is possible for the vase thread 30 to be provided on an inner surface of the vase 20. While it is illustrated that the vase threat 30 does not extend all the way around the vase 20, in other configurations, the vase thread 30 extends all the way around the vase 20.

The vase lid 22 may have a variety of shapes using the concepts of the invention. The vase lid 22 includes a vase lid thread 32. When the vase thread 30 is on an outer surface of the vase 20, the vase lid thread 32 is on an inner surface of the vase lid 22. The vase lid thread 32 is capable to engaging the vase thread 30 to secure the vase lid 22 to the vase 20. As such, the vase thread 32 may have a shape that is at least partially complementary to the vase thread 30.

The vase lid 22 may have at least one vase lid handle 34 extending from a surface thereof. The vase lid handle 34 may assume a variety of shapes using the concepts of the invention. The vase lid handle 34 may enhance the ability to attach the vase lid 22 to the vase 20 and to detach the vase lid 22 from the vase 20.

Figure 5:
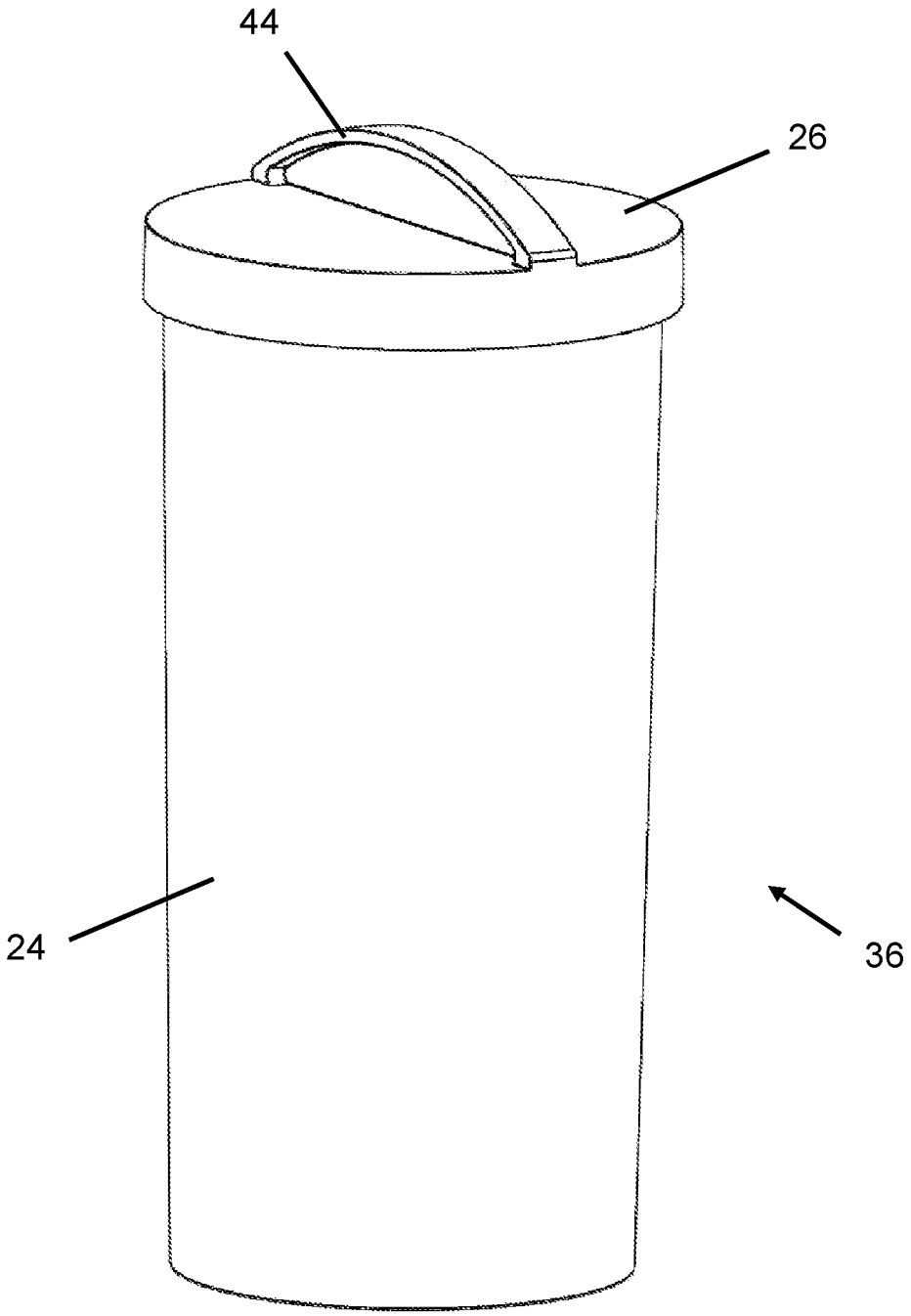
FIG. 5 is a perspective view of an urn for the cremated remains remembrance system.
Figure 6:
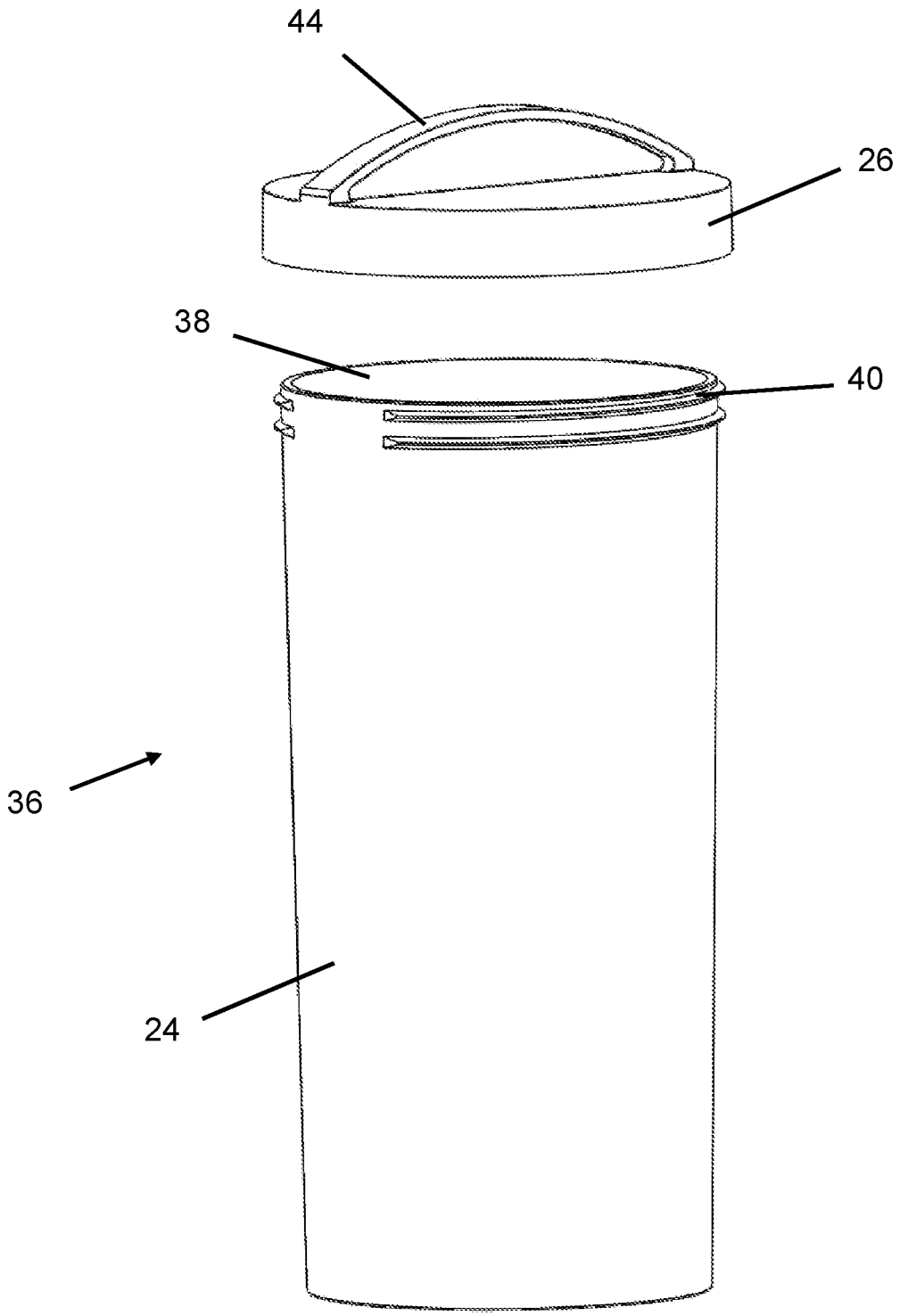
FIG. 6 is an exploded perspective view of the urn with an urn lid separate from an urn body.

The urn body 24 may assume a variety of shapes using the concepts of the invention. In certain embodiments, the urn body 24 has a generally cylindrical shape as illustrated in FIGS. 5 and 6. The urn body 24 has an opening 38 formed therein that is adapted to receive cremated remains. Proximate the urn body opening 38, an urn body thread 40 is provided. The urn body thread 40 facilitates removable attachment of the urn lid 26 to the urn body 24. A person of skill in the art will appreciate that the number of threads in the urn body thread 40 as well as the shape and size of the threads in the urn body thread 40 may be varied such as to increase the sealing ability.

While it is illustrated that the urn body thread 40 is on an outer surface of the urn body 24, it is possible for the urn body thread 40 to be provided on an inner surface of the urn body 24. While it is illustrated that the urn body thread 40 does not extend all the way around the urn body 24, in other configurations, the urn body thread 40 extends all the way around the urn body 24.

The urn lid 26 may have a variety of shapes using the concepts of the invention. The vase lid 22 includes a vase lid thread 32. When the vase thread 30 is on an outer surface of the vase 20, the vase lid thread 32 is on an inner surface of the vase lid 22. The vase lid thread 32 is capable to engaging the vase thread 30 to secure the vase lid 22 to the vase 20. As such, the vase thread 32 may have a shape that is at least partially complementary to the vase thread 30.

The urn lid 26 may have at least one urn lid handle 44 extending from a surface thereof. The urn lid handle 44 may assume a variety of shapes using the concepts of the invention. The urn lid handle 44 may enhance the ability to attach the urn lid 26 to the urn body 24 and to detach the urn lid 26 from the urn body 24. The urn lid handle 44 may also facilitate placing the urn 36 into the vase 20 and removing the urn 36 from the vase 20.

It is also possible to include a thread on the vase 20 that engages a thread on one of the urn body 24 or the urn lid 26 that the urn 36 to be retained in a generally stationary position with respect to the vase 20 when the urn 36 is placed inside of the vase 20. Using such a configuration, the thread on the vase 20 would have a shape that is at least partially complementary to the thread on one of the urn body 24 or the urn lid 26.

The thread on the vase 20 may be distinct from the vase thread 30 that is discussed above. Similarly, the thread on at least one of the urn body 24 or the urn lid 26 may be distinct from the urn body thread 40 and the urn lid thread 42 that are discussed above.

Figure 7:
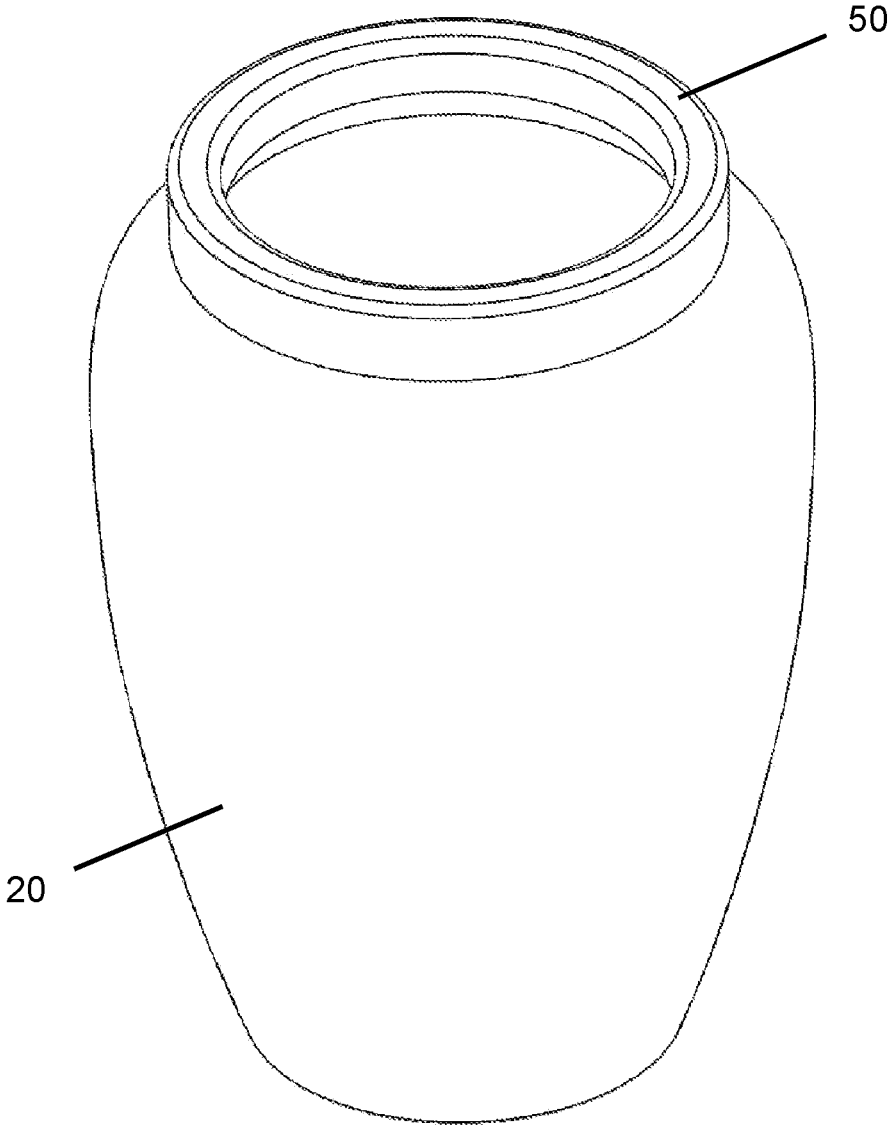
FIG. 7 is a perspective view of the vase with a decorative ring attached thereto.
Figure 8:
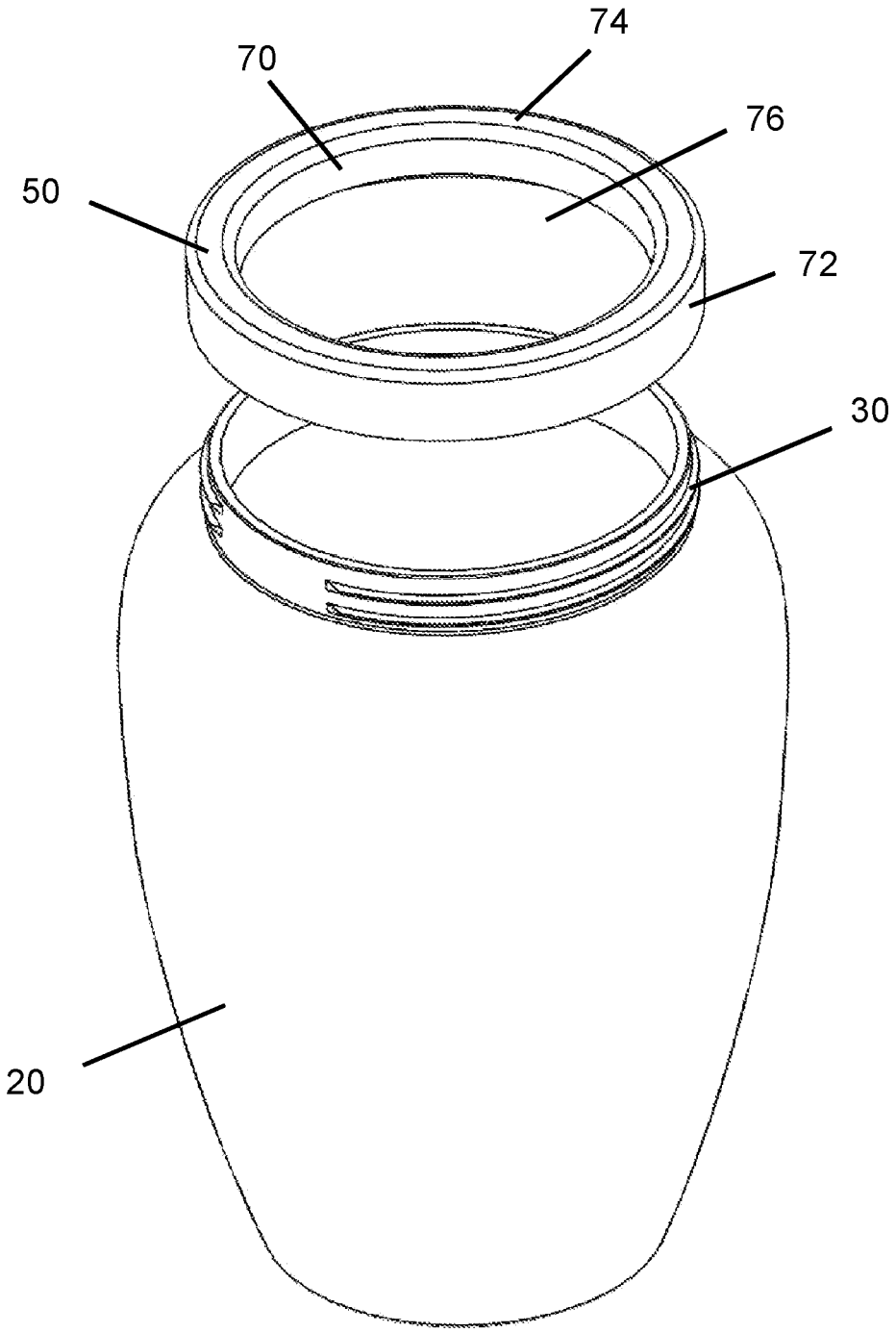
FIG. 8 is an exploded perspective view of the vase and the decorative ring.

The decorative ring 50 is capable of removably attachment to the vase 20, as illustrated in FIGS. 7 and 8. In contrast to the vase lid 22 that substantially encloses the vase opening 28, the decorative ring 50 is open in the middle so that after the decorative ring 50 is attached to the vase 20, it is possible for objects to be placed into the vase 20. By enabling the objects to be placed into the vase 20, the decorative ring 50 enhances the utility of the vase 20 after it is done using the vase 20 to store cremated remains.

Figure 9:
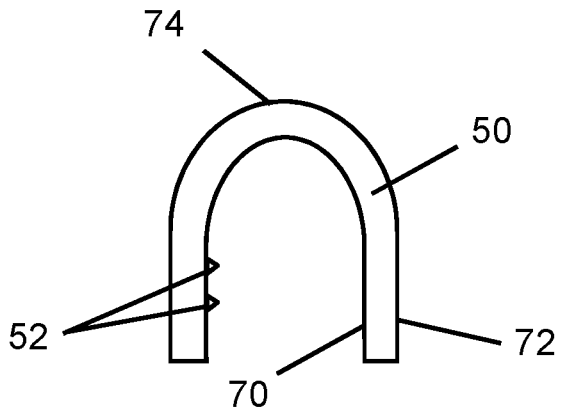
FIG. 9 is a sectional view of the decorative ring.

The decorative ring 50 may generally include an inverted U-shaped profile as illustrated in FIG. 9. As used herein, inverted U-shaped means that the decorative ring 50 includes an inner panel 70, an outer panel 72 and a top panel 74 that extends between the inner panel 70 and the outer panel 72. In certain embodiments, the inner panel 70 may be oriented substantially parallel to the outer panel 72.

While it is illustrated that the inner panel 70 has a length that is similar to a length of the outer panel 72, it is possible for the inner panel 70 and the outer panel 72 to have different lengths. In particular, the length of the outer panel 72 may be longer than a length of the inner panel 70. Such a configuration facilitates substantially covering the vase thread 30.

While it is illustrated that the inner panel 70 and the outer panel 72 engage the top panel 74 proximate upper ends of the inner panel 70 and the outer panel 72, other configurations are possible. For example, at least one of the inner panel 70 and the outer panel 72 may extend higher than the top panel 74. Such a configuration may enable a height of the vase 20 to be increased through the attachment of the decorative ring 50 to the vase 20.

It is illustrated that the inner panel 70 and the outer panel 72 are proximate inner and outer surfaces of the vase 20 proximate the vase opening 28, such that a size of an opening 76 that extends through the decorative ring 50 is similar to a size of the vase opening 28. It is possible for the decorative ring opening 76 to be smaller than the vase opening 28. Such a situation may be desirable where the object that is desired to be placed in the vase 20 is quite a bit smaller than the size of the vase opening 28.

It is possible for the decorative ring 50 to have alternative configurations using the concepts of the invention. In one such alternative configuration, the decorative ring 50 includes only the outer panel 72 and the top panel 74. It is also possible for the decorative ring 50 to only include the inner panel 70 and the top panel 74. Such a configuration may be used where the vase thread 30 is on an inner surface of the vase 20. In yet another configuration, it is possible for the decorative ring 50 to only include an outer panel 72.

A decorative ring thread 52 may be provided on an inner surface of the decorative ring 50. The decorative ring thread 52 engages the vase thread 30 to retain the decorative ring 50 in removable attachment with the vase 20. When the decorative ring 50 is attached to the vase 20, the decorative ring 50 substantially covers the vase thread 30. By substantially covering the vase thread 30, the decorative ring 50 enhances an appearance of the vase 20.

It is possible for alternative techniques to be used to attach the decorative ring 50 to the vase 20. For example, the decorative ring 50 may be permanently attached to the vase 20 such that once the decorative ring 50 is attached to the vase 20, it is not possible to detach the decorative ring 50 from the vase 20. One potential technique to permanently attach the decorative ring 50 to the vase 20 is an adhesive.

This profile enables the decorative ring 50 to be placed over the portion of the vase 20 proximate the vase opening 28 to thereby cover the vase thread 30. The decorative ring 50 thereby enhances the aesthetic appearance of the vase 20 so that the vase 20 may be used for alternative applications such as for holding flowers.

A benefit of attaching the decorative ring 50 to the vase 20 is that by substantially covering the vase thread 30, the vase 20 appears to be less associated with the vase 20 being used to store cremated remains of a deceased person and more like a conventional household decoration or a piece of art.

Concealing the prior use of the vase 20 as storing cremated remains of a deceased person may be particularly beneficial in situations where the person desires to display the vase 20 as a remembrance of the deceased person whose cremated remains were previously stored in the vase 20 while not potentially negatively impacting persons who are sensitive about death in general or about the death of the person whose cremated remains were previously stored in the vase 20.

The decorative ring 50 may have an appearance on an outer surface thereof that is similar to an appearance of an outer surface of the vase 20 proximate to where the decorative ring 50 is attached to the vase 20. Such an appearance reduces a potential of a person perceiving the decorative ring 50 as being a separate component from the vase 20. As used herein, the term appearance means at least one of a color, design and texture.

In use, cremated remains (not shown) are placed in the urn body opening 38, which is then closed using the urn lid 26 to form the urn 36. The urn 36 is then placed into the vase 20, which is then closed using the vase lid 22 to form the cremated remains remembrance system 10 for display such as during a memorial service. After the memorial service is complete, the vase lid 22 is detached from the vase 20 and the urn 36 is removed from the vase 20. The decorative ring 50 is attached to the vase 20 such that the vase 20 can be used for other purposes as discussed above.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A cremated remains remembrance system comprising:

a vase having an opening formed therein, wherein the vase has a first attachment mechanism and wherein proximate the vase opening, the vase has an inner wall and an outer wall;

an urn in which cremated remains are placed, wherein when the cremated remains remembrance system is in a first configuration, the urn is placed at least partially in the vase opening;

a vase lid that is capable of engaging the first attachment mechanism to substantially close the vase opening when the cremated remains remembrance system is in the first configuration; and a decorative ring that comprises an inner panel, an outer panel and a top panel that extends between the inner panel and the outer panel, wherein the decorative ring has an opening extending therethrough and is capable of engaging the first attachment mechanism to substantially cover the first attachment mechanism when the cremated remains remembrance system is in a second configuration where the urn is not in the vase opening and the vase lid is not attached to the vase, wherein when the decorative ring is attached to the vase, the inner panel is proximate the inner wall and the outer panel is proximate the outer wall and an object may be placed into the vase.

2. The cremated remains remembrance system of claim 1, wherein the decorative ring further comprises a second attachment mechanism that engages the first attachment mechanism when the decorative ring is attached to the vase.

3. The cremated remains remembrance system of claim 2, wherein the first attachment mechanism is a thread that extends from a surface of the vase and wherein the second attachment mechanism is a thread that extends from a surface of the decorative ring.

4. A cremated remains remembrance method comprising:

providing a vase having an opening formed therein, wherein the vase has a first attachment mechanism and wherein proximate the vase opening, the vase has an inner wall and an outer wall;

providing a decorative ring comprising an inner panel, an outer panel and a top panel that extends between the inner panel and the outer panel, wherein the decorative ring has an opening extending therethrough;

placing cremated remains in an urn;

positioning the urn at least partially in the vase opening;

attaching a vase lid to the vase by engaging the first attachment mechanism to substantially close the vase opening;

detaching the vase lid from the vase;

removing the urn from the vase opening;

attaching the decorative ring to the vase by engaging the first attachment mechanism and wherein when the decorative ring is attached to the vase, the decorative ring substantially covers the first attachment mechanism, the inner panel is proximate the inner wall and the outer panel is proximate the outer wall; and extending an object through the decorative ring opening and partially in the vase after the decorative ring is attached to the vase.

5. The method of claim 4, and further comprising conducting a remembrance service for a person whose cremated remains are in the urn while the urn is positioned at least partially in the vase opening.

6. The method of claim 4, wherein the substantially covering the first attachment mechanism with the decorative ring conceals that the vase previously had cremated remains placed therein and thereby reduces a potential that a person who is sensitive about death in general or about death of the person whose cremated remains were previously in the vase.

7. The method of claim 4, wherein the attachment of the decorative ring to the vase enhances an aesthetic appearance of the vase as compared to when the vase lid is detached from the vase and the decorative ring is detached from the vase.

8. The method of claim 4, wherein the decorative ring further comprises a second attachment mechanism and wherein the second attachment mechanism engages the first attachment mechanism when the decorative ring is attached to the vase.

9. The method of claim 8, wherein the first attachment mechanism is a thread that extends from a surface of the vase and wherein the second attachment mechanism is a thread that extends from a surface of the decorative ring.

10. A method of forming a household decoration comprising:

providing a vase having an opening formed therein, wherein the vase has a first attachment mechanism and wherein proximate the vase opening, the vase has an inner wall and an outer wall;

providing a decorative ring comprising an inner panel, an outer panel and a top panel that extends between the inner panel and the outer panel, wherein the decorative ring has an opening extending therethrough;

placing cremated remains in an urn;

positioning the urn at least partially in the vase opening;

attaching a vase lid to the vase by engaging the first attachment mechanism to substantially close the vase opening;

detaching the vase lid from the vase;

removing the urn from the vase opening; and attaching the decorative ring to the vase by engaging the first attachment mechanism and wherein when the decorative ring is attached to the vase, the decorative ring substantially covers the first attachment mechanism, the inner panel is proximate the inner wall and the outer panel is proximate the outer wall to form a household decoration and an object may be placed into the vase.

11. The method of claim 10, and further comprising conducting a remembrance service for a person whose cremated remains are in the urn while the urn is positioned at least partially in the vase opening.

12. The method of claim 10, wherein the substantially covering the first attachment mechanism with the decorative ring conceals that the vase previously had cremated remains placed therein and thereby reduces a potential that a person who is sensitive about death in general or about death of the person whose cremated remains were previously in the vase.

13. The method of claim 10, and further comprising extending a decorative object through the decorative ring opening and partially in the vase opening after the decorative ring is attached to the vase.

14. The method of claim 10, wherein the attachment of the decorative ring to the vase enhances an aesthetic appearance of the vase as compared to when the vase lid is detached from the vase and the decorative ring is detached from the vase.

15. The method of claim 10, wherein the decorative ring further comprises a second attachment mechanism and wherein the second attachment mechanism engages the first attachment mechanism when the decorative ring is attached to the vase.

16. The method of claim 15, wherein the first attachment mechanism is a thread that extends from a surface of the vase and wherein the second attachment mechanism is a thread that extends from a surface of the decorative ring.

* * * * *